US008863562B1

(12) United States Patent
Leving

(10) Patent No.: US 8,863,562 B1
(45) Date of Patent: Oct. 21, 2014

(54) COMBINATION LOCK AND ANTI-JIMMYING DEVICE

(75) Inventor: Robert Leving, Chicago, IL (US)

(73) Assignee: Jeffery Leving, Chicago, IL (US)

( * ) Notice: Subject to any disclaimer, the term of this patent is extended or adjusted under 35 U.S.C. 154(b) by 118 days.

(21) Appl. No.: 12/277,970

(22) Filed: Nov. 25, 2008

Related U.S. Application Data

(60) Provisional application No. 60/991,619, filed on Nov. 30, 2007.

(51) Int. Cl.
*E05B 67/38* (2006.01)

(52) U.S. Cl.
USPC ..... 70/55; 70/53

(58) Field of Classification Search
USPC ..... 70/53–56
See application file for complete search history.

(56) References Cited

U.S. PATENT DOCUMENTS

| | | | | | |
|---|---|---|---|---|---|
| 2,375,488 | A * | 5/1945 | Olson | 70/54 |
| 2,904,985 | A * | 9/1959 | Murphy | 70/51 |
| 3,777,517 | A * | 12/1973 | Shwayder et al. | 70/53 |
| 3,908,415 | A * | 9/1975 | Foote | 70/53 |
| 3,976,434 | A * | 8/1976 | Shwayder | 70/53 |
| 4,224,813 | A * | 9/1980 | Hampton | 70/53 |
| 4,226,100 | A * | 10/1980 | Hampton et al. | 70/53 |
| 4,308,730 | A * | 1/1982 | Roth | 70/53 |
| 4,888,967 | A * | 12/1989 | Kuo | 70/52 |
| 5,488,845 | A * | 2/1996 | Hsieh | 70/38 A |
| 2004/0011093 | A1 * | 1/2004 | Fantl | 70/53 |
| 2004/0093914 | A1 * | 5/2004 | Vito | 70/56 |

* cited by examiner

*Primary Examiner* — Christopher Boswell
(74) *Attorney, Agent, or Firm* — Cherskov Flaynik & Gurda, LLC

(57) ABSTRACT

Embodiments relate to a padlock shackle guard for any padlock that includes a housing and a shackle. The guard is slid upon the shackle to prevent interjection of a jimmying device in-between the shackle and the padlock housing when the shackle is engaged within the padlock housing.

15 Claims, 4 Drawing Sheets

Prior Art

Prior Art

COMBINATION LOCK AND ANTI-JIMMYING DEVICE

CROSS REFERENCE TO RELATED APPLICATIONS

This application is based upon and claims the benefit of U.S. provisional application No. 60/991,619, entitled "COMBINATION LOCK AND ANTI-JIMMYING DEVICE", filed Nov. 30, 2008 by Robert Leving, the entire disclosure of which is herein specifically incorporated by reference for all that it discloses and teaches.

BACKGROUND OF THE INVENTION

1. Field of the Invention

This invention relates to a device and method for managing and preventing unauthorized access to locking mechanisms of padlock, and in particular, the invention relates to a substrate and a method for preventing access to the locking mechanism of a shackle-containing lock.

2. Background of the Invention

Possessions and premises are regularly secured against theft and unauthorized access using a variety of locking mechanisms. Often, security is provided using a padlock. Padlocks can employ a number of potential means to detect authorized access. For example, padlocks which use combination locks, and padlocks using keys are both well-known and understood.

FIG. 1A depicts a padlock showing a vulnerability to jimmying of the lock. The invention that is the object of the present application is designed to be used as a retrofitting piece for such padlocks. Typical padlocks comprise two parts: a main body 11 and a shackle 5. Both ends are rotatable. The shackle 5 in turn comprises a fixed end 19 and a movable or free end 9. The fixed end 19 never disengages from the main body 11 even while the padlock 10 is opened. Instead, the fixed end 19 remains within the padlock body 11 while at most allowing for rotational and longitudinal communication of the shackle with the main body 11. The free end 9, on the other hand, disengages from the padlock locking mechanism so as to allow engagement of the shackle 5 into a loop of a locking apparatus. The free end 9 leaves the main body 11 when the padlock 10 is opened. When the padlock 10 is closed, the free end 9 is received by an aperture formed on a surface of the padlock body 11. The free end 9 of the shackle 5 further comprises a rectilinear portion 15 and a curved portion 17.

As FIG. 1A shows, the padlock 10 suffers from a weakness independent of the type of locking internal mechanism (not shown) found within padlock body 11. Specifically, a jimmying device, such as a thin strip of metal or a simple metal hook, can access and trip the locking mechanism of the padlock via the annular space 13 formed when the free end 9 of the shackle 5 is engaged in the padlock body 11.

As the weakness point for jimmying of a padlock is the annular space 13, it is irrelevant what manner of locking mechanism is used within the padlock body 11. As such, a key activated lock (as depicted in FIG. 1A), a combination lock, or even padlocks that use sophisticated electronics are all vulnerable. The weakness exists in all padlocks that feature a shackle with at least one free end that is received into a padlock main body through an annular space or aperture.

Turning to FIG. 1B, therein depicted is the unprotected prior art padlock 10, shown in the open configuration. In the open configuration, the fixed end 19 of the shackle 5 provides a means for the shackle 5 to be extended out of the padlock main body 11. The free end 9 of the shackle 5 is completely free of the padlock main body 11 so that the end point 14 of the free end 9 of the shackle 5 is accessible. Also visible is a cam body receiving surface 16 of the free end 9 of the shackle 5 which end engages the locking mechanism found within the body 11 of the padlock 10 said mechanism typically enclosed within the cam body.

The notch or serration defining the cam body receiving surface 16 depicted in FIG. 1B is depicted for demonstrative purposes only. It should be understood that many different fashions or designs of notches 16 exist. However, the same vulnerability exists regardless of the type of female coupling configuration defining the receiving surface 16 that is used by the padlock 10. Mainly, a jimmying device can be used to disengage the locking mechanism from the serration 16 regardless of the shape of the serration 16 and even regardless of the sophistication of the locking mechanism, as discussed in conjunction with FIG. 1A.

Virtually, all locking mechanisms, regardless of their sophistication, can be bypassed if a jimmying device is interjected between the padlock shackle and the locking mechanism. Thus, there is a need for a cost-effective means to protect padlocks from jimmying devices that bypass even the most sophisticated locking mechanisms.

SUMMARY OF THE INVENTION

An object of the invention is to provide a device and method of preventing disengagement of a padlock shackle from its locking mechanism which overcomes many of the disadvantages of the prior art.

It is a further object of the present invention to provide the means to secure a padlock that can be applied to pre-existing padlocks. A feature of the invention is a shackle guard adapted to be inserted onto the free end of a padlock shackle whilst the padlock is opened, but which cannot be removed when the padlock is closed. An advantage of the invention is that the device can be employed to improve the security of padlocks existing and as such, the present invention can retrofit padlocks prone to unauthorized access.

An additional object of the present invention is to provide a method of tamper-proofing existing padlocks. A feature of the invention is the imposition of a tamper-proof barrier around the shackle of the lock, whereby the barrier defines a substrate with a radius of curvature larger than that defined by the cross-section of the shackle of the lock so as to envelop a depending portion of the shackle. An advantage of the invention is that it can be used repeatedly and interchangeably in instances where products by multiple padlock manufacturers are in concurrent use.

A further object of the present invention is to create a padlock security device that can be installed by a padlock-end user with no requirement of assembly. A feature of the present invention is that, in one embodiment, a shackle guard slidably communicates with a free end of the shackle, obviating the need for any modification of the padlock or shackle. An advantage of the present invention is that it does not require a permanent mounting onto the padlock shackle and can be combined with several different types of padlocks.

Another object of the invention is to provide a padlock shackle that is easy to install by the end user. A feature of the invention is that, in one embodiment, the shackle guard includes a first end that has a larger diameter than the second end of the guard. A feature of an embodiment of the invention is that the larger first end is received by the shackle first such that the introduction of the guard is characterized as having frictional engagement with the shackle at the start compared to when the shackle is fully nested within the guard. A feature of another embodiment of the invention is that the first end of the guard has a different shape than that of the second end. An advantage of the present invention is that the end user will be able to install the guard without applying excessive force which prevents unnecessary wear on the shackle and guard. Another advantage is that the guard will always be installed in the correct orientation due to the different shapes and manufacturing tolerances.

Yet another object of the invention is to protect a lock from tampering and to allow unhindered access to the locking mechanism while the free end of the shackle is engaged in the padlock body. A feature of the invention is isolating normally vulnerable rectilinear regions of a shackle while the shackle is engaged with the locking mechanism of the padlock. An advantage of the invention is that the guard of the present invention may be employed to improve the security of a padlock regardless of the type of mechanism used to detect authorized users.

Another object of the invention is a method to protect a shackle of a closed padlock sleeve along the nested shackle. A feature of the invention is the removable insertion of a barrier over the shackle such that, in one embodiment, the length of the shackle is optimized to substantially encompass the rectilinear portion of the free end of the shackle. An advantage of the invention is that the guard is prevented from moving longitudinally along the nested shackle while simultaneously being free to rotate about the shackle.

Yet another object of the invention is a method of protecting a shackle guard of a closed padlock installed along the nested shackle. A feature of the invention is the support of rotational movement of the shackle guard that, in one embodiment, prevents engagement of cutting means around the shackle guard.

Briefly, the invention provides a padlock shackle guard for a padlock defining a housing, the guard comprising a substrate adapted to be inserted between the housing and a shackle nested within the housing.

DESCRIPTION OF THE DRAWING

Embodiments together with the above and other objects and advantages may best be understood from the following detailed description of the embodiments illustrated in the drawings, wherein.

DETAILED DESCRIPTION OF THE INVENTION

Figure 1A:
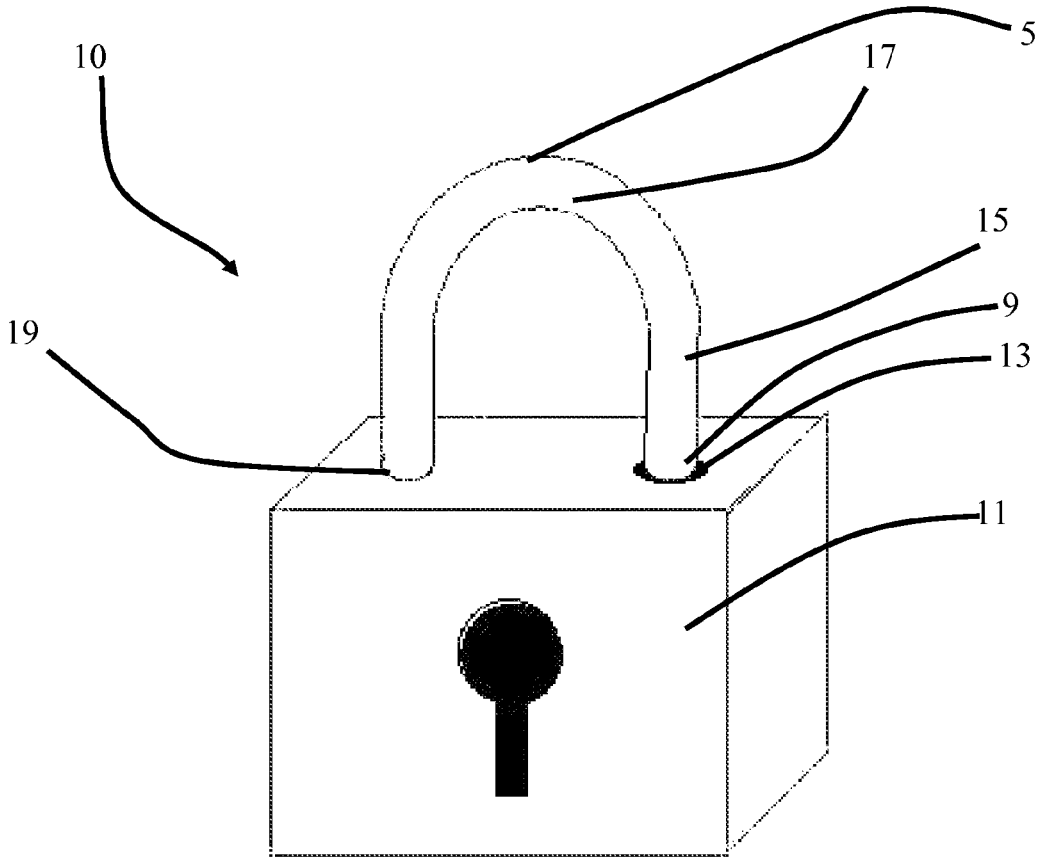
FIGS. 1A and 1B depict a padlock, which under the prior art remains vulnerable to jimmying.
Figure 1B:
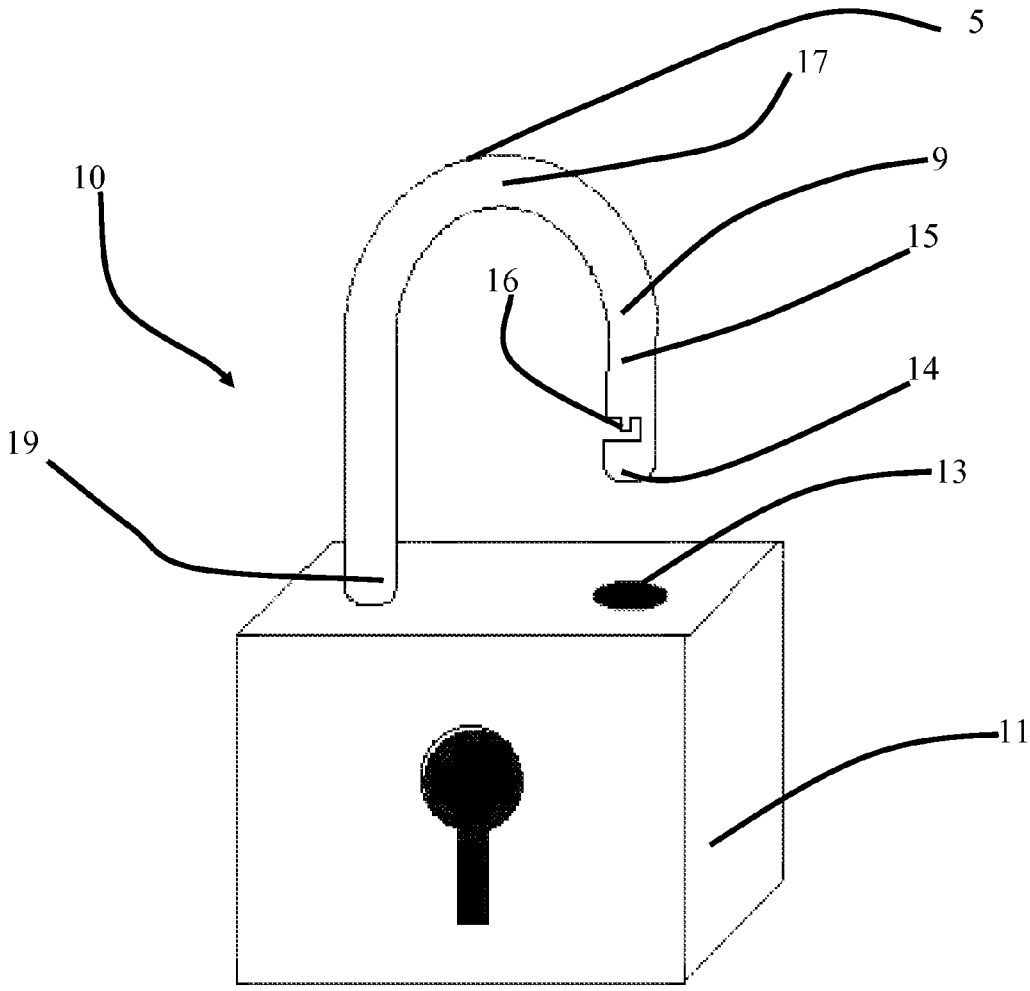
Figure 2:
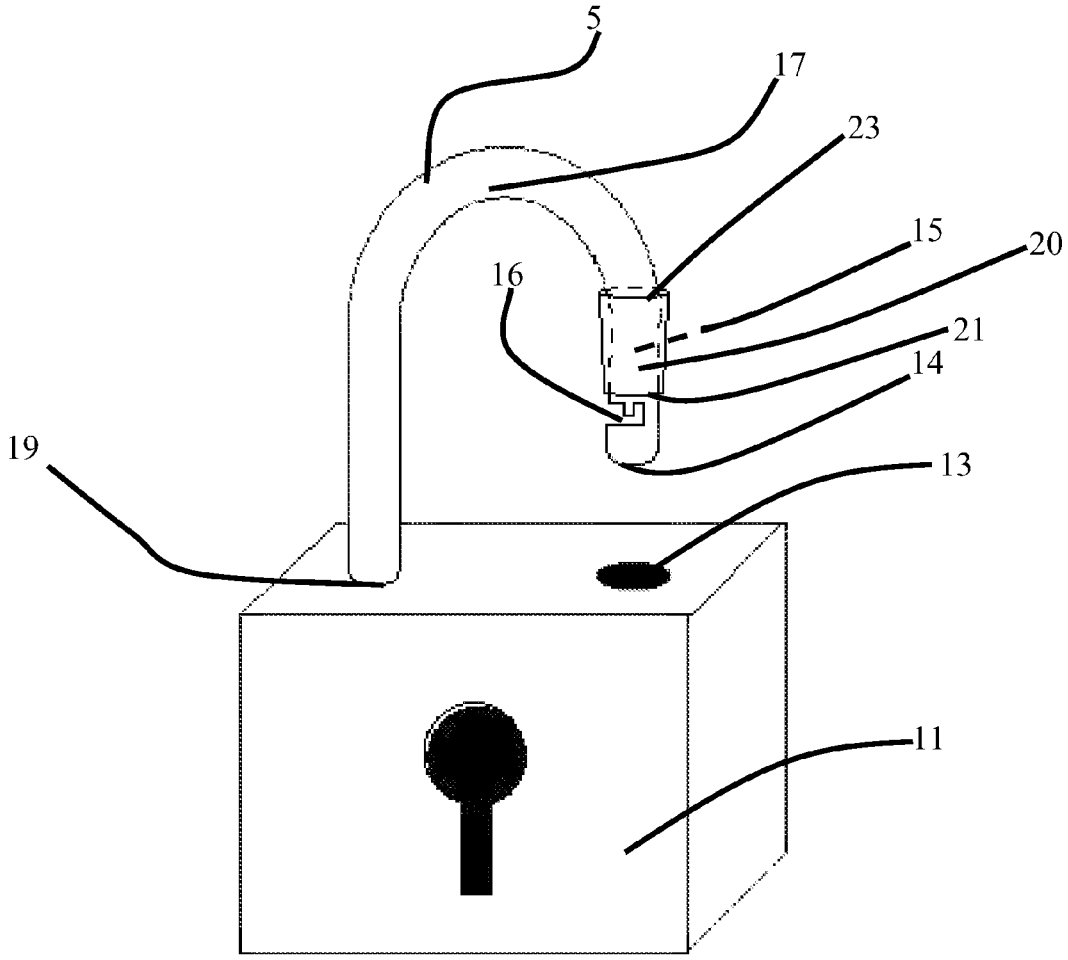
FIG. 2 depicts a padlock shackle cover installed on a padlock shackle in accordance with one embodiment of the invention.

Turning to FIG. 2, the padlock system shown there includes the invented means to prevent unauthorized access per one embodiment of the invention. Specifically, shown as part of FIG. 2, is a protective sleeve 20 adapted to slidably communicate with a rectilinear portion 15 of the padlock shackle 5. The protective sleeve 20 extends over a depending region comprising the shackle rectilinear portion 15.

To secure the padlock, the sleeve 20 is slidabily installed onto the free end of the shackle following the release of the shackle end point 14 from the padlock main body 11. In one embodiment, the sleeve 20 features a first end 23 and a second end 21. During installation of the sleeve 20, the first end 23 is first inserted onto the shackle point 14. The sleeve 20 is then slidably installed until the sleeve 20 reaches its designated location along the shackle 5. The sleeve may either frictionally engage the shackle so as to be limited in freely rotating about the periphery of the shackle. Another embodiment exists whereby sleeve engagement allows for free rotation. In this embodiment, an interior of the sleeve comprises frictionless material (such as Teflon®).

To prevent movement along the shackle towards the curved portion 17, in some embodiments the sleeve length is selected to correspond to the length of the rectilinear portion 15. For instance, in some embodiments, the sleeve 20 length ranges from between 90 and 100 percent of the length of the rectilinear portion 15. Further, to prevent the movement of the sleeve 20 past the rectilinear portion 15, in some embodiments, the first end 23 of the sleeve 20 features a larger diameter than the second end 21 of the sleeve 20. A larger outer diameter of the first end 23 prevents movement of the sleeve 20 inasmuch as the first end 23 impacts the curved portion 17 of the shackle 5.

Further, a larger outer diameter of the first end 23 facilitates ease of installation of the sleeve 20. The inventor appreciates that often padlocks are operated (and especially closed) with only one hand. As such, the sleeve facilitates slidable engagement over the free end point 14 of the shackle 5. In an embodiment where the first end 23 of the sleeve 20 has a larger diameter than the second end 21 of the sleeve 20, it is easier to align the sleeve 20 with the end point 23 of the shackle.

In an alternative embodiment (not shown), the cross section of first end 23 of the sleeve 20 can also feature a different geometrical shape than the second end 21 of the sleeve 20. For example, the first end can have a polygonal (i.e. pentagonal, hexagonal, heptagonal, and so forth) cross section, while the second end 21 features a circular cross section or a cross section of another polygon similar to that of the shackle and/or shackle receiving aperture of the padlock housing. The use of a polygonal cross section for the first end 23 enables non-visual identification of the first end 23. As such, it aids in the ease of installation. Further, the polygonal sides of the first end 23 readily rest against the curved section 17 of the free end of the shackle and as such prevent lateral movement of the sleeve 20 past the rectilinear portion 15 of the shackle.

As FIG. 2 demonstrates, the sleeve 20 resides in close spatial relationship to the shackle. There must be sufficient space between the inner surface of the sleeve 20 and the shackle to facilitate installation, inasmuch as the purpose of the sleeve 20 is to prevent interjection of a jimmying device between the shackle and the locking mechanism within the padlock body. As such, in embodiments of the present invention, the inner diameter of the second end 21 of the sleeve 20 should be adapted to not exceed 102 percent of the outer diameter of the shackle.

Once the padlock is closed, the sleeve 20 is positioned within the annular space 13 and prevents introduction of jimmying device. As such, it is important that the sleeve 20 not be allowed to move longitudinally along the nested shackle so as to be extractable from the annular space. If the sleeve 20 is allowed to move, even a small amount, the jimmying instrument could once again be introduced and used to disengage the shackle from the padlock body.

Various embodiments of the present invention employ different approaches to prevent the lateral movement of the sleeve 20. For example, as was discussed in one approach above, the sleeve 20 length is between 90 to 100 percent the length of the rectilinear portion 15 of the shackle, thereby preventing the sleeve 20 from moving superior to the rectilinear portion. Movement is hindered by the curvature of the shackle; said curvature starting with the conclusion of the rectilinear portion 15. Alternative embodiments prevent lateral movement by the introduction of a polygonal cross section to the first end 23 of the sleeve 20 as discussed above.

Another embodiment of the invention (not shown) prevents rotational movement of the sleeve by introducing a reversibly deformable substrate that engages the bottom of the sleeve and wraps around the end point of the free end of the shackle. The substrate features an aperture to allow access to the notch on the free end of the shackle. Inasmuch as the substrate wraps around the end point of the free end of the shackle, it will prevent the movement of the sleeve along the shackle. However, to allow the substrate to be inserted into the padlock body without interfering with the locking mechanism, the substrate should be composed of a reversibly deformable material that is nonetheless durable.

Figures 3, 3B:
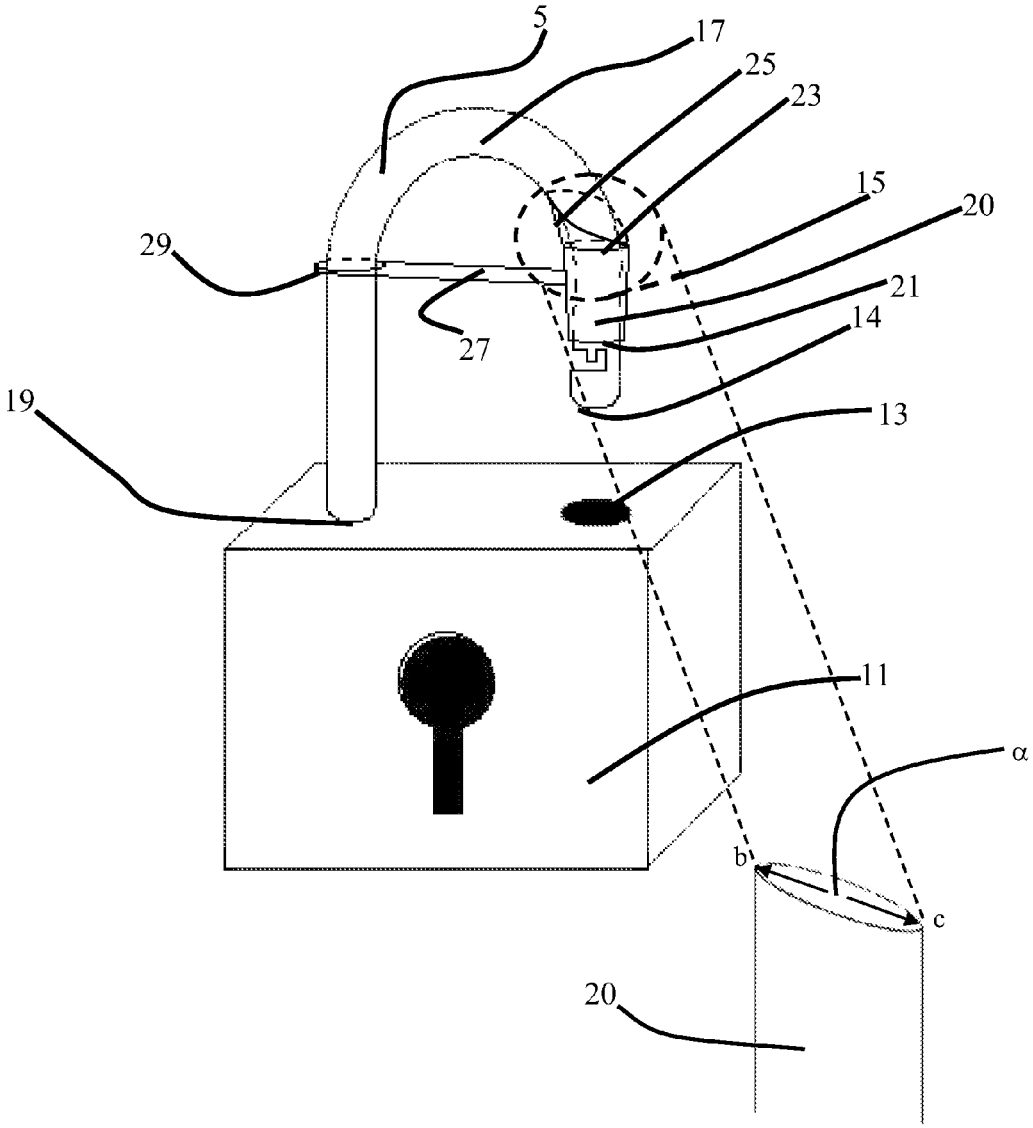
FIG. 3 depicts a padlock shackle cover installed on the free end of a padlock shackle in accordance with an alternative embodiment of the invention.

Yet another method of preventing movement of the sleeve when the padlock is closed is shown in FIG. 3. Shown in FIG. 3 is a sleeve which includes additional means to prevent movement of the sleeve 20 along the padlock shackle 5. The means to prevent movement could be an additional appendage 25 extending upwardly from a top edge of the sleeve to contact concaved surfaces of the curved portions of the shackle as shown in FIG. 3.

As depicted in FIG. 3B, this substrate can be integrally molded with a top edge of the sleeve 20 such to define an ellipsoidal shaped mouth, having a longitudinal axis a. Opposing regions b and c of the ellipsoidal mouth simultaneously contact the shackle when the sleeve 20 is positioned on the shackle.

In another embodiment, the sleeve 20 includes a cross-bar 27 which is received by the fixed end 19 of the padlock. The introduction of the cross-bar 27 prevents rotation of the sleeve 20 along the axis formed by the rectilinear section 15 of the padlock shackle 5. While the cross-bar 27 is pictured as protruding perpendicularly from the middle of the sleeve 20, it should be appreciated that the cross-bar 27 could originate at any position along the length of the sleeve 20 including at either the first end 21 or the second end 23 of the sleeve 20. Furthermore, more than one cross-bar 27 can be accommodated.

When the sleeve 20 is installed on the shackle, the cross-bar 27 is first slidably received by the fixed end of the shackle. In the embodiment shown in FIG. 3, the cross-bar 27 completely encircles the fixed end of the shackle 19 by passing the fixed end of the shackle through an aperture 29. However, it should be appreciated that the cross-bar 27 need not entirely encircle the fixed end of the padlock and instead can be opened on the end 29 opposite to the sleeve 20.

As such, the embodiment depicted in FIG. 3 is designed to prevent lateral movement of the sleeve 20 along the padlock shackle 5. The alternative embodiment of FIG. 3 can be used in conjunction with pre-existing padlocks that are not compatible with the other embodiments disclosed previously.

The cross-bar and other features of this embodiment can be made less conspicuous by the use of properly colored substrate, such as a substrate matching the color of the padlock. Alternatively, the elements may be manufactured from a clear substrate.

Each of the embodiments is designed so as to allow the retrofit of any pre-existing padlock. Inasmuch as padlocks are often used outdoors or other situations where they may be exposed to corrosive environments, the padlock guard should be composed of a material that does not oxidize. Further, because the padlock guard may be in contact with metal padlock components for extended periods of time, the guard should be composed of a substrate that does not lead to galvanic corrosion of padlock components such as the padlock body or the padlock shackle.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The embodiment of the invention in which an exclusive property or privilege is claimed is defined as follows:

1. A padlock shackle guard for a padlock defining a housing, the guard comprising a substrate defining a rigid, inflexible sleeve having a first end and a second end, the sleeve being adapted to be slidably installed onto a free end of a shackle, wherein the shackle is comprised of a first rectilinear section, a second rectilinear section, and curved section disposed between the first and second rectilinear sections, and inserted between the housing and the shackle nested within the housing, said sleeve being designed to retrofit pre-existing padlocks that can be installed by an end user with no requirement of assembly wherein said sleeve only frictionally engages with said shackle, said sleeve being rotatable when the padlock is closed, said first end of the sleeve abutting the curved section of the shackle, which thereby renders the sleeve substantially fixed in its longitudinal position when the padlock is in a closed position, and said sleeve being removable from the shackle when the padlock is opened.

2. The guard as recited in claim 1 further comprising a means for preventing insertion of a tool between said sleeve and the housing.

3. The guard as recited in claim 1 further comprising an aperture to facilitate engagement of a depending region of the shackle with a locking mechanism contained in the housing.

4. The guard as recited in claim 1 wherein the sleeve further comprises a main body comprising a tubular sleeve with inner diameter 102 percent the diameter of the shackle nested within the housing.

5. The guard as recited in claim 1 wherein the sleeve further comprises a main body with length of 90 percent to 100 percent the length of the first rectilinear portion when the shackle is in the closed position.

6. The guard as recited in claim 1 wherein the sleeve further comprises a reversibly deformable substrate that engages the free end of the shackle nested within the housing.

7. The guard as recited in claim 1 wherein the sleeve first end comprises a different geometrical shape than the sleeve second end.

8. The guard as recited in claim 1 wherein the sleeve further comprises a means for preventing longitudinal movement of the sleeve along the nested shackle.

9. The guard as recited in claim 1 further comprising a housing having a surface with an opening defining and annular space for receiving the free end of the shackle, wherein the sleeve in positioned in the annular space when the padlock is closed.

10. The guard as recited in claim 1 wherein the first end defining a larger outer diameter than the second end.

11. A method for preventing unauthorized opening of a padlock, the method comprising preventing insertion of a tool between a housing of the padlock and a shackle nested within the housing, wherein the shackle is comprised of a first rectilinear section, a second rectilinear section, and curved section disposed between the first and second rectilinear sections, the method further comprising encapsulating a depending region of the nested shackle with a slidably installed rigid, inflexible sleeve, said sleeve being designed to retrofit pre-existing padlocks that can be installed by an end user with no requirement of assembly wherein said sleeve only frictionally engages with said shackle, said sleeve being rotatable when the padlock is closed, said sleeve having at least a portion of the sleeve abutting the curved section of the shackle, which thereby renders the sleeve substantially fixed in its longitudinal position when the padlock is in a closed position, and said sleeve being removable from the shackle only when the padlock is opened, said sleeve further being adapted to be used repeatedly and interchangeably on multiple different padlocks.

12. The method as recited in claim 11 further simultaneously allowing engagement of the shackle with a cam limiter of the lock.

13. The method as recited in claim 12 wherein the sleeve is first slid over the shackle when the shackle is not nested in the housing and then limited in rectilinear movement over the shackle when the shackle is nested within the housing.

14. A padlock shackle guard for a padlock defining a housing, the guard consisting of a substrate defining a rigid, inflexible sleeve having a first end and a second end, the sleeve being adapted to be slidably installed onto a free end of a shackle, wherein the shackle is comprised of a first rectilinear section, a second rectilinear section, and curved section disposed between the first and second rectilinear sections, and inserted between the housing and the shackle nested within the housing, said sleeve being designed to retrofit pre-existing padlocks that can be installed by an end user with no requirement of assembly wherein said sleeve only frictionally engages with said shackle, said sleeve being rotatable when the padlock is nested, said first end of the sleeve abutting the curved section of the shackle, which thereby renders the sleeve substantially fixed in its longitudinal position when the padlock is in a closed position, and said sleeve being removable from the shackle only when the padlock is opened.

15. The padlock shackle guard as recited in claim 14 wherein the first end defining a larger outer diameter than the second end.

* * * * *